US005533657A

United States Patent [19]

Rosen et al.

[11] Patent Number: 5,533,657

[45] Date of Patent: Jul. 9, 1996

[54] FIREARM ACCESSORY CONCEALMENT HOLDER

[76] Inventors: Mitchell S. Rosen, 1220 Black Brook Rd., Dunbarton, N.H. 03045; Dean Speir, 74 Main St., Westhampton Beach, N.Y. 11978-2691

[21] Appl. No.: 200,069

[22] Filed: Feb. 22, 1994

[51] Int. Cl.[6] ..... A45F 5/00

[52] U.S. Cl. ..... 224/673; 224/191; 224/200; 224/911; 224/914; 224/682

[58] Field of Search ..... 224/191, 200, 224/223, 226, 252, 253, 231, 911, 914; D3/229; 362/202, 200

[56] References Cited

U.S. PATENT DOCUMENTS

| | | | |
|---|---|---|---|
| 1,898,171 | 2/1933 | Bunnell | 224/253 |
| 2,817,472 | 12/1957 | Parkhurst | 224/223 |
| 4,094,450 | 6/1978 | Parlante et al. | 224/911 |
| 4,591,081 | 5/1986 | Bianchi et al. | 224/911 |
| 5,351,868 | 10/1994 | Beletsky et al. | 224/914 |

OTHER PUBLICATIONS

Laser Products Brochure 71–03–002 4–93 20 M, p. 15; Apr. 1993.

Mitchell Leatherworks Double Magazine Carrier #5 DM.

*Primary Examiner*—Henry J. Recla
*Assistant Examiner*—Charles R. Eloshway
*Attorney, Agent, or Firm*—Peter A. Luccarelli, Jr.

[57] ABSTRACT

A firearm accessory holder which facilitates concealed carry on a belt of a wearer, includes a backing portion, having upper, left and right lateral sides, and a rear face for placement against the wearer; belt slots for threading of a belt therethrough, attached to the backing portion; and a first pouch portion, attached to the backing portion and canted toward the wearer, for retention of a flashlight of the type having a biased actuation switch on one end thereof, the first pouch portion having a limiting portion constructed for defining clearance between the actuation switch and the first pouch portion. The accessory holder may include a second pouch portion for retention of a firearm ammunition magazine.

19 Claims, 3 Drawing Sheets

FIREARM ACCESSORY CONCEALMENT HOLDER

BACKGROUND OF THE INVENTION

This invention is directed to firearm accessory holders designed for placement on the waist belt of a wearer, and in particular, holders designed for concealed carry by wearers who are authorized to bear concealed weapons.

Persons who are authorized by law to carry concealed weapons, such as military and law enforcement personnel, peace officers, private investigators and private citizens often prefer to do so discreetly, so as not to draw attention to themselves by other fellow citizens. In the case of law enforcement personnel assigned to undercover duty, the ready appearance of firearms or accessories could jeopardize the success of their assignment or possibly even their lives.

Two of the most common activities in which concealed firearms wearers can compromise their concealment are during routine walking movement and while bending at the waist. Both activities can "telegraph" existence of firearms and accessories by the shifting or appearance of "bulges" through the wearers' garments about the waist. The bulges are often created by relative movement of the firearm or accessories and the wearer's body. Movement or shifting of firearms and accessories relative to the wearer's body also impedes quick access in times of stress; the wearer has to fumble around to find where the desired object has moved.

Their is a great demand by persons who carry concealed firearms for holsters, belts and firearms accessory holders, (often called "leatherware" in the industry), which provide ready concealment under garments, yet which also allow ready access to the firearms and accessories when needed quickly during potentially violent confrontations. Firearms accessories often needed in conjunction with firearms include firearm ammunition recharging devices (i.e., spring-loaded box magazines for rifles, pistols or shotguns, revolver speed loaders, speed strips, stripper clips, individual ammo round holders and en-bloc clips), short batons or other impact instruments, defensive chemical immobilization sprays (i.e., pepper and/or teargas), handcuffs and flashlights.

In response to the need for concealment holsters and ammunition concealment pouches, manufacturers have developed leatherware of different designs which attempt to maximize concealment yet which provide for ready access to the wearer. One such manufacturer is Mitchell Leatherworks of Dunbarton, N.H., U.S.A. Mitchell Leatherworks sells single and double ammunition magazine carriers, sold under the "#5M" and "#5DM" trademarks, respectively.

The aforementioned Mitchell Leatherworks magazine carriers are constructed with contoured backing portions for conformity to the wearer's body and a pair of belt slots which draw the backing portions close to the wearer upon belt tightening. The pouch portions of the aforementioned Mitchell Leatherworks magazine carriers are canted toward the wearer's body, and are closed at the bottom thereof in order to limit magazine insertion into the carrier. The magazine pouch portions are intentionally cut low in order to leave a great length of the ammunition magazine exposed for easy grasping by the wearer in high-stress reloading situations. As a result, the aforementioned magazine carriers closely hug the wearer, blending with the natural profile of abdomen and torso, and maintain a consistent position on the wearer's belt, while leaving a relatively large length of the magazine exposed for ready and rapid grasping by the wearer. Thus the Mitchell Leatherworks magazine carriers eliminate the appearance of "bulges" around the wearer's waist during routine movement, even during bending motions. Mitchell Leatherworks also sells complimentary handgun holsters, sold under the trademarks "ARG", "#5G", "#5JR" and "#SPT".

While manufacturers, such as Mitchell Leatherworks have sold concealment holsters and magazine carriers, less attention has been given by manufacturers to other firearms accessory concealment holders. One critical accessory is the flashlight, which is needed for suspect identification and general illumination. Uniformed military and police personnel often carry large multi-cell flashlights in open pouches or rings on their duty belts. Traditional police/military flashlights were too large for concealed carry on a wearer's belt.

A newer generation of flashlights utilizes high illumination bulbs and high performance lithium or alkaline style batteries that provide levels of candlepower comparable to traditional military and police flashlights. One representative example of the new generation of small flashlights is the "SUREFIRE ® 6P" sold by Laser Products of Fountain Valley, Calif., U.S.A. The "SUREFIRE" flashlight is only of the order of 6 inches (15 centimeters) long and has a barrel diameter of the order of 1 inch (2.5 centimeters); it has a biased actuation button at the end distal the bulb and lens which is surrounded by a threaded annular ring. Depression of the actuation button by the user turns on the light. The new generation of small, compact, high performance flashlights are now being carried in concealed fashion, as firearms and spare ammunition carriers have been in the past. This has necessitated accessory holders for concealed flashlight carry.

Existing prior art accessory holders for compact, concealment flashlights have been inadequate for proper concealment carry. As shown in FIG. 1, the compact, high performance flashlight 20 has a biased actuation button 22 which is constrained by an annular ring-shaped cap 23, and is retained in holder 24. The holder 24 has a cylindrical pouch portion 26 with a belt retainer 28 in the form of a sewn-in-place or snap-fitted tunnel loop, or a spring clip. The belt retainer 28 is placed high on the upper end of the cylindrical pouch 26, so that the remainder of the pouch hangs below the wearer's belt.

As shown in the partial cut-away portion of FIG. 1, the top lens and bulb module of the flashlight contacts the holder 24 top rim 30 of the cylindrical pouch portion 26 when fully inserted therein, and the pouch portion is constructed longer than the barrel portion of the flashlight 20, so that clearance is left between the bottom of the cylindrical pouch portion 26 and the actuation button 22. This clearance prevents inadvertent actuation of the flashlight actuation button 22, which could otherwise occur if the flashlight 20 is stored in a traditional closed bottom pouch, which relies upon flashlight bottom edge direct contact with the pouch bottom.

Such a known compact flashlight holder 24 shown in FIG. 1 does not keep the flashlight close to the wearer's body. In fact, it tends to allow the lower end of the free-hanging pouch portion 26 to flop around, which in turn causes "bulges" in outer garments, especially when the wearer walks quickly or bends at the waist. Only the lens and bulb portion of the flashlight 20, but not its barrel portion, are exposed for grasping by the wearer. As with spare ammunition magazine carriers, it is desirable to have a greater portion of the flashlight 20 exposed for easy grasping in high-stress emergencies and confrontations. Unfortunately, if the prior art flashlight holder 24 cylindrical portion 26 is shortened to expose more of the flashlight 20, the actuation switch 22 will abut directly against the pouch portion 26 bottom, which might inadvertently turn on the flashlight. Alternative carry techniques for compact flashlights are even more unsatisfactory: they include merely shoving the bare flashlight into the wearer's belt or stuffing it into pockets. Both alternatives leave the flashlight prone to loss and moreover, the light constantly tends to shift in the pocket or lose under the belt.

There is a need for firearms accessory concealment holders which provide for discreet, concealed carry of flashlights, batons and the like, which maintain a relatively constant position on a wearer's belt and which minimize telltale "bulges" through garments.

There is also a need for firearms accessory concealment holders which provide for discreet, concealed carry of flashlights, batons and the like, which do not cause inadvertent actuation of actuation switches due to contact of the holder and the actuation switch, yet which allow a relatively large length of the accessory to be freely exposed for easy, rapid grasping by the wearer.

SUMMARY OF THE INVENTION

It is an object of the present invention to create firearms accessory concealment holders which provide for discreet, concealed carry of flashlights, batons and the like, which maintain a relatively constant position on a wearer's belt and which minimize telltale "bulges" through garments by maintaining close contact of the holder and accessory with the wearer's body.

It is also an object of the present invention to create firearms accessory concealment holders which provide for discreet, concealed carry of flashlights, batons and the like, which do not cause inadvertent actuation of actuation switches due to contact of the holder and the actuation switch, yet which allow a relatively large length of the accessory to be freely exposed for easy, rapid grasping by the wearer.

These objects have been attained by the firearm accessory holders of the present invention, which facilitate concealed carry on a belt of the wearer. One aspect of the firearm accessory holder of the present invention features a backing portion, having upper, left and right lateral sides, and a rear face for placement against the wearer; at least one belt retainer for threading of a belt therethrough, attached to the backing portion; and a first pouch portion, attached to the backing portion and canted toward the wearer, for retention of a flashlight of the type having a biased actuation switch on one end thereof, the first pouch portion having a limiting portion constructed for defining clearance between the actuation switch and the first pouch portion.

Another aspect of the present invention includes a firearm accessory holder which facilitates concealed carry on a belt of a wearer, comprising: a backing portion, having upper, left and right lateral sides, and a rear face for placement against the wearer; at least one belt retainer for threading of a belt therethrough, oriented for canting the upper side of the backing portion toward the wearer upon belt tightening; a first pouch portion, attached to the backing portion and canted toward the wearer, for retention of a first type of firearm accessory device, the first pouch portion having a limiting portion constructed for limiting insertion of the first accessory device therein and a void portion proximal the limiting portion for defining clearance between a portion of the first accessory device and the first pouch portion; and a second pouch portion, attached to the backing portion and canted toward the wearer, for retention of a firearms ammunition recharging accessory device.

Another aspect of the present invention is directed to a firearm accessory holder which facilitates concealed carry on a belt of a wearer, comprising: a backing portion, having upper, left and right lateral sides, and a concave rear face for placement against the wearer; a pair of integrally formed belt slots, for threading of a belt therethrough, defined by the backing portion; a first pouch portion, integrally formed by the backing portion and canted toward the wearer, for retention of a flashlight of the type having a biased actuation switch on one end thereof, the first pouch portion having a limiting portion constructed for limiting insertion of the flashlight therein and a void portion proximal the limiting portion for defining clearance between the flashlight actuation switch and the first pouch portion; and a second pouch portion, integrally formed by the backing portion and canted toward the wearer, for retention of a firearms ammunition recharging device.

DETAILED DESCRIPTION OF THE PREFERRED EMBODIMENT

It is noted at the outset that the detailed description of the preferred embodiment is intended to enable those skilled in the art to understand how to make and use the present invention. The scope of the invention is recited in the claims. Numerous changes can be made to the preferred embodiment while practicing the present invention as set forth in the claims herein.

Figure 3:
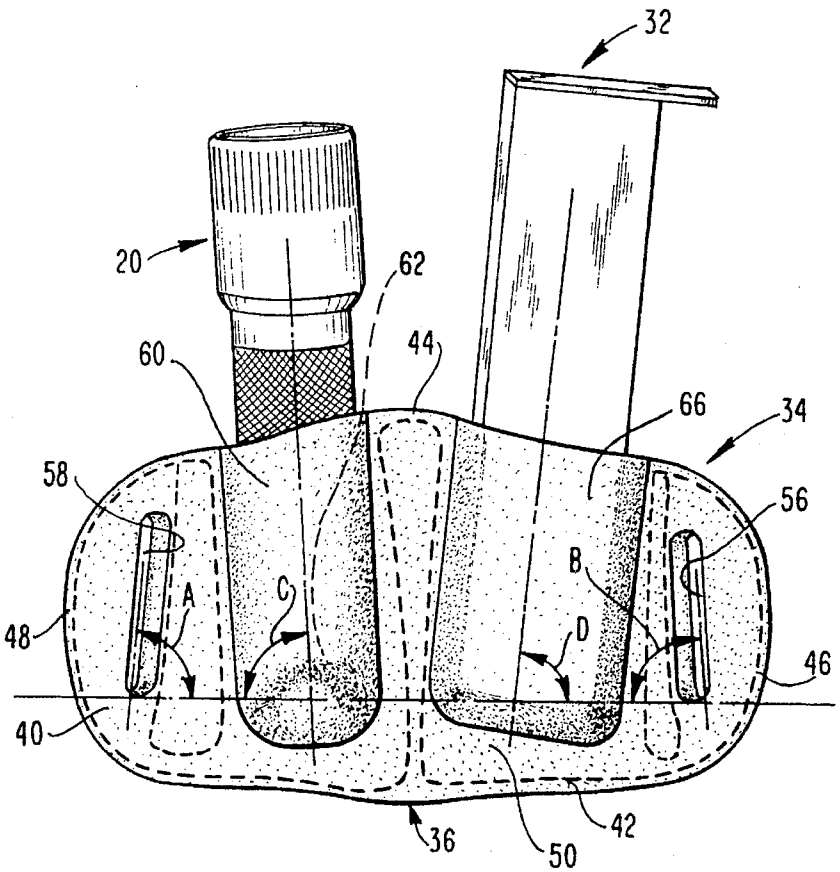
FIG. 3 is rear elevational view of the invention of FIG. 2.
Figure 2:
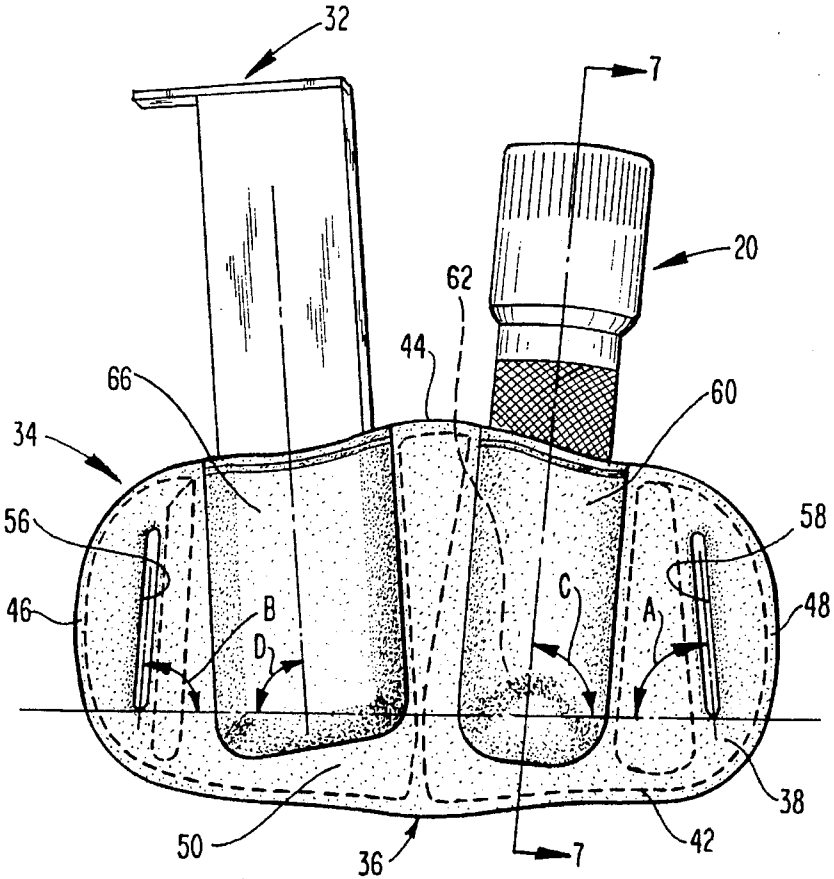
FIG. 2 is a front elevational view of the concealment firearm accessory holder of the present invention with a flashlight retained therein and a second pouch portion with a pistol magazine retained therein.
Figure 4:
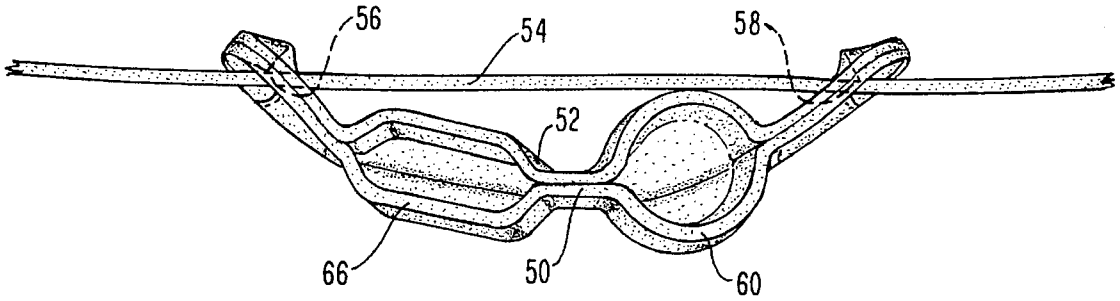
FIG. 4 is a top plan view thereof.
Figure 5:
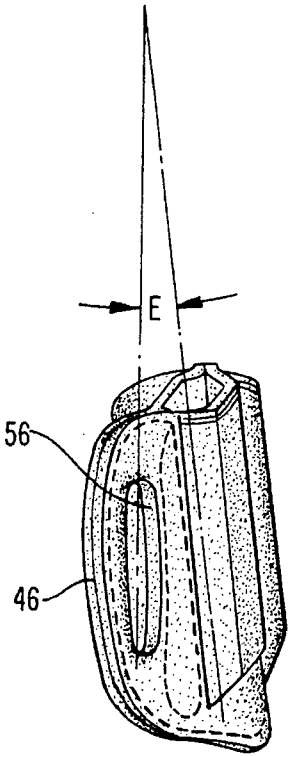
FIG. 5 is a left side elevational view thereof.
Figure 6:
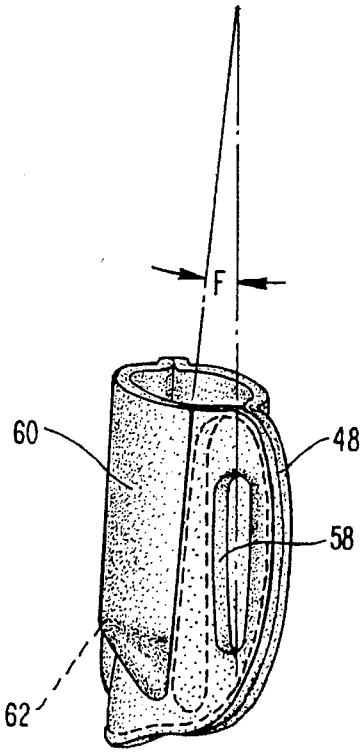
FIG. 6 is a right side elevational view thereof.

Referring generally to FIGS. 2 and 3, prior art flashlight 20 and prior art ammunition magazine 32 are retained in firearm accessory concealment holder 34 (hereafter referred to as "holder 34") of the present invention. Flashlight 20 and ammunition magazine 32 were not invented by the inventors of the present application.

The holder 34 has a backing portion 36, which as shown in FIGS. 2–7 is constructed of first and second sheets of leather 38, 40 which are preferably glued and stitched along stitch line 42 with techniques well known in the leatherware industry. The holder 34 can be constructed of leather or other materials, with other construction techniques known in the leatherware industry. For example, the holder 34 can be constructed of leather which is stitched, but not glued, or constructed of: natural and/or synthetic fabrics, combination fabric with foam plastic core, laminated materials, or molded plastics. As can be appreciated to those skilled in the art, molded plastic accessory holders can be constructed by injection or blow molding techniques.

Referring again to FIGS. 2–4, the generally planar backing portion 36 has upper 44, left 46, right 48 lateral sides, a front face 50 which faces away from a wearer when worn on a belt, and a generally concave rear face 52 which is placed against the wearer, though of course it should be understood that the wearer's belt 54 and any garments will be interposed between the rear face 52 and the wearer's body.

The backing portion 36 also has at least one belt retainer for threading of the belt 54 therethrough, which as shown includes a pair of integrally formed belt slots 56, 58 proximal the left side 46 and right 48 sides, respectively. The belt slots 56, 58 tend to draw the holder 34 snugly against the wearer's body upon drawing and tightening of the belt 54.

The backing portion 36 has a first pouch portion 60 which retains flashlight 20 so that approximately half the length of the flashlight remains exposed for ready grasping by the wearer. Preferably first pouch portion is constructed to enable a tight friction fit around the flashlight 20 barrel, which inhibits inadvertent loss during strenuous movement. However, if desired, the pouch to may loosely retain the flashlight 20 barrel. Other types of flashlight retention devices may be utilized in conjunction with holder 34, such as retention straps, spring-biased friction blocks, tensioning screws and the like. If a hard metal insert (not shown) is constructed to reinforce pouch 60, the insert may simply be bent to retain flashlight 20 securely within the pouch.

Figure 7:
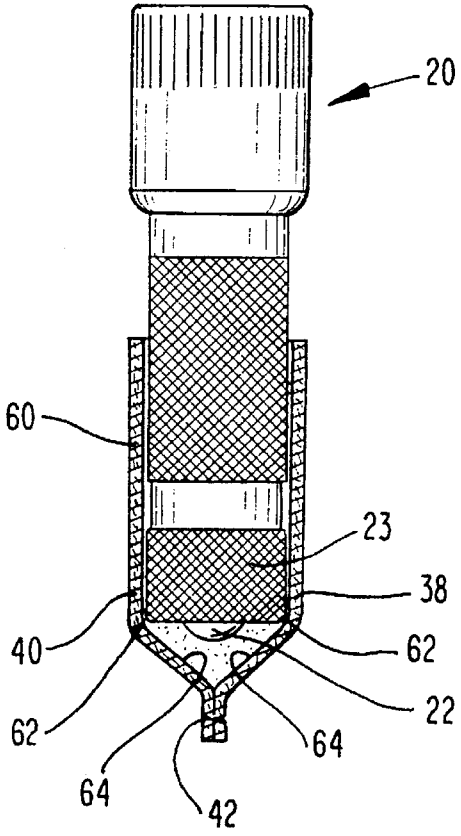
FIG. 7 is a partial sectional view of FIG. 2, taken along 7—7 thereof.
Figure 1:
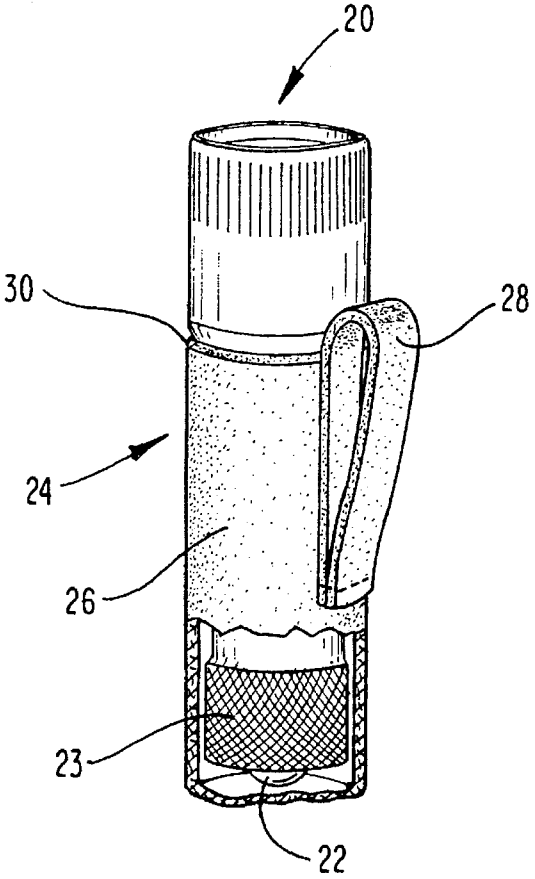
FIG. 1 (PRIOR ART)
FIG. 1 shows a perspective, partial cutaway view of a prior art compact flashlight and prior art flashlight holder.

As shown clearly in the cutaway portion of FIG. 7, first pouch portion 60 is constructed with a limiting portion 62 which is in the nature of a generally wedge-shaped 64 constriction in its generally cylindrical-shaped profile. The wedge-shaped constriction 64 abuts the ring-shaped end cap 23 of the flashlight 20, which forms a void portion within the first pouch portion 60 for clearance away from the flashlight actuation switch 22. Other constriction 64 profiles may be chosen, provided they limit insertion of the flashlight 20, yet provide clearance between the first pouch portion 60 and the actuation switch 22 and allow ready grasp of the flashlight. The first pouch portion 60 may be constructed to retain other types of firearms accessories, such as impact batons, defensive chemical pepper and/or teargas sprays, pens, knives or the like.

The holder 34 also preferably has a second pouch portion 66 for retention of box magazine 32 for pistols, rifles or shotguns, though a holder only employing a flashlight retention pouch may be constructed. If desired, second pouch portion 66 can be constructed to retain other types of firearm ammunition recharging accessory devices, such as revolver speed loaders, individual ammunition cartridges, speed strips, stripper clips and en-bloc clips. It is preferable that a substantial portion of the magazine 32 or other ammunition recharging device be exposed for easy grasping by the wearer. It is also preferable that the second pouch 66 be constructed to retain magazine 32 tightly, in order to inhibit inadvertent loss. Other retention devices may be utilized, as previously described with respect to the first pouch 60 retention of the flashlight 20.

The first pouch 60 and second pouch 66 portions are canted toward the wearer by skewing and forming both the belt slots 56, 58 relative to the backing portion 36 and curving the backing portion itself in accordance with the angles A, B, C, D, E and F shown in FIGS. 3–6. Angles A–D are generally between approximately 70 degrees and 85 degrees. Angles E and F are between approximately 5 degrees and 15 degrees.

What is claimed is:

1. A holder for retaining a flashlight having a predetermined cross-section which facilitates concealed carry on a belt of a wearer, comprising:

a. a backing portion, having upper, left and right lateral sides, and a rear face for placement against the wearer;

b. at least one belt retainer for threading of a belt therethrough, coupled to the backing portion; and c. a first pouch portion, coupled to the backing portion and canted toward the wearer, for forming therebetween a first pouch contoured to the cross-section of the flashlight for retention of a flashlight of the type having a biased actuation switch on one end thereof, at least one of the backing portion and the first pouch portion having a limiting portion constructed for defining clearance between the actuation switch and the first pouch portion.

2. The holder of claim 1, wherein the clearance is defined by a void portion proximal the limiting portion.

3. The holder of claim 2, wherein the void portion has a generally wedge shape.

4. The holder of claim 1, wherein the belt retainer includes at least one belt slot which cants the upper side of the backing portion toward the wearer.

5. The holder of claim 4, having a pair of belt slots, integrally formed in the backing portion proximal the left and right lateral sides thereof.

6. The holder of claim 1, wherein at least a portion of the first pouch is integrally formed in the backing portion.

7. The holder of claim 1, further comprising a second pouch portion coupled to the backing portion and forming therebetween a second pouch for retention of a firearm ammunition recharging accessory device.

8. A firearm accessory holder which facilitates concealed carry on a belt of a wearer, comprising:

a. a backing portion, having upper, left and right lateral sides, and a rear face for placement against the wearer;

b. at least one belt retainer for threading of a belt therethrough, oriented for canting the upper side of the backing portion toward the wearer upon belt tightening;

c. a first pouch portion, coupled to the backing portion and canted toward the wearer, for forming therebetween a first pouch for retention of a flashlight having a predetermined cross-section, at least one of the backing portion and the first pouch portion having a limiting portion constructed for limiting insertion of the flashlight therein and a void portion proximal the limiting portion for defining clearance between a portion of the flashlight and the first pouch portion; and d. a second pouch portion, coupled to the backing portion and canted toward the wearer, for forming therebetween a second pouch for retention of a firearms ammunition recharging accessory device.

9. The firearm accessory holder of claim 8, wherein the void portion has a generally wedge shape.

10. The firearm accessory holder of claim 8, wherein the belt retainer includes at least one belt slot.

11. The firearm accessory holder of claim 10, having a pair of belt slots, integrally formed in the backing portion proximal the left and right lateral sides thereof.

12. The firearm accessory holder of claim 8, wherein at least a portion of at least one of the first and second pouches is integrally formed in the backing portion.

13. The firearm accessory holder of claim 12, wherein the backing portion is formed of leather.

14. The firearm accessory holder of claim 8, wherein the backing portion is generally planar.

15. A firearm accessory holder which facilitates concealed carry on a belt of a wearer, comprising:

a. a backing portion, having upper, left and right lateral sides, and a concave rear face for placement against the wearer;

b. a pair of integrally formed belt slots, for threading of a belt therethrough, defined by the backing portion;

c. a first pouch portion coupled to the backing portion and forming therebetween a first pouch, at least a portion of which first pouch is integrally formed by the backing portion and canted toward the wearer, for retention of a flashlight having a predetermined cross-section and having a biased actuation switch on one end thereof, at least one of the backing portion and the first pouch portion having a limiting portion constructed for limiting insertion of the flashlight therein and a void portion proximal the limiting portion for defining clearance between the flashlight actuation switch and the first pouch portion; and d. a second pouch portion coupled to the backing portion and forming therebetween a second pouch, at least a portion of which second pouch is integrally formed by the backing portion and canted toward the wearer, for retention of a firearms ammunition recharging device.

16. The firearm accessory holder of claim 15, wherein the belt slots are oriented proximal the left and right lateral sides of the backing portion and which cant the upper side of the backing portion toward the wearer.

17. The firearm accessory holder of claim 15, wherein the flashlight actuation switch includes an annular ring and a biased actuation diaphragm disposed within the annular ring; the first pouch limiting portion abuts against the annular ring and the actuation diaphragm is disposed within the void portion.

18. The firearm accessory holder of claim 15, wherein the void portion has a generally wedge shape.

19. The firearm accessory holder of claim 15, wherein the backing portion is formed of leather.

* * * * *